US010907528B2

(12) United States Patent
Boffelli

(10) Patent No.: US 10,907,528 B2
(45) Date of Patent: Feb. 2, 2021

(54) PUMP FOR RECIRCULATING A COOLING FLUID FOR COMBUSTION ENGINES WITH ELECTRIC MOTOR CONTROL DEVICE

(71) Applicant: BARUFFALDI S.P.A., Tribiano (IT)

(72) Inventor: Piercarlo Boffelli, Tribiano (IT)

( * ) Notice: Subject to any disclaimer, the term of this patent is extended or adjusted under 35 U.S.C. 154(b) by 0 days.

(21) Appl. No.: 16/486,093

(22) PCT Filed: Feb. 19, 2018

(86) PCT No.: PCT/IB2018/050997
§ 371 (c)(1),
(2) Date: Aug. 14, 2019

(87) PCT Pub. No.: WO2018/150385
PCT Pub. Date: Aug. 23, 2018

(65) Prior Publication Data

US 2020/0056533 A1 Feb. 20, 2020

(30) Foreign Application Priority Data

Feb. 20, 2017 (IT) ..... 102017000018662

(51) Int. Cl.
*F02D 13/06* (2006.01)
*F01P 5/12* (2006.01)
*F04D 13/06* (2006.01)
*F04D 15/00* (2006.01)

(52) U.S. Cl.
CPC ..... *F01P 5/12* (2013.01); *F04D 13/06* (2013.01); *F04D 15/0077* (2013.01); *F01P 2005/125* (2013.01); *F01P 2031/00* (2013.01)

(58) Field of Classification Search
CPC .... F01P 2005/125; F01P 2031/00; F01P 5/12; F04D 13/06
See application file for complete search history.

(56) References Cited

U.S. PATENT DOCUMENTS

2006/0165539 A1* 7/2006 Boffelli ..... F01P 5/12 417/319
2008/0017468 A1* 1/2008 Krafft ..... F01P 7/084 192/40
2008/0079322 A1* 4/2008 Kanazawa ..... H02K 1/145 310/44
2011/0253077 A1* 10/2011 Boffelli ..... F01P 7/084 123/41.44
2015/0037177 A1* 2/2015 Buchholz ..... F01P 5/12 417/319
2017/0037853 A1* 2/2017 Modica ..... F16D 27/14

* cited by examiner

*Primary Examiner* — Long T Tran

(57) ABSTRACT

Pump for recirculating a cooling fluid for a vehicle with combustion engine, comprising: —a pump body (11) designed to be fixed to a base (11*a*) of the vehicle engine; an impeller (1) inserted inside a chamber containing the cooling fluid and mounted on a driven shaft (2), at least one first electric motor (50) for driving the shaft (2) of the impeller (1), wherein—said electric motor (50) comprises a fixed stator (51) mounted on the body (11) of the pump on the outside thereof and a rotor (52) radially outer lying with respect to the stator and connected to the shaft (2) of the impeller (1) of the pump on the outside of the cooling fluid chamber and via transmission means (54, 54*a;* 354, 354*a;* 54*a,* 66), and wherein the electric motor is designed to operate the impeller independently of the combustion engine.

13 Claims, 2 Drawing Sheets

PUMP FOR RECIRCULATING A COOLING FLUID FOR COMBUSTION ENGINES WITH ELECTRIC MOTOR CONTROL DEVICE

BACKGROUND OF THE INVENTION

The present invention relates to a pump for recirculating the cooling fluid for combustion engines, in particular of vehicles, with an electric motor control device which is independent of the combustion engine.

It is known in the sector for the production of engines, in particular combustion engines, that there exists the need to cool said engines by means of recirculation of a cooling fluid which is driven by means of a corresponding recirculating pump, the impeller of which is inserted inside a chamber containing the cooling fluid and rotated by a shaft driven by a pulley and by a belt connected to the drive shaft operated by the engine.

It is also known that the recirculation of the cooling fluid must be performed with a flowrate depending on the actual cooling requirement determined by the real conditions of use of the engine and by the external temperature, in order to avoid the constant and unnecessary operation at full speed of devices which consume useful power and thereby increase the wear of the various component parts and the consumption levels of the vehicle.

It is also known that, in order to solve this problem, devices for controlling operation of the pump impeller shaft have been proposed, rotation of the shaft depending on the engagement of a friction coupling for transmission of a rotational movement according to the speed of the engine shaft and on an electric motor which instead is activated, when the friction coupling is disengaged, so as to perform rotation at a controlled speed independently of the engine shaft.

Examples of these devices are for example known from WO 2012/142065 and IT 102014902265953.

Although fulfilling their function these devices nevertheless have a number of drawbacks which limit their applications, in particular since the particular configuration of the structure results in the need for larger axial and radial dimensions which are not compatible with the small dimensions of the seats for housing the assembly inside the engine compartment.

Further examples of the prior art are described in DE 198 01 160, where an electric motor is arranged between the shaft of the pump impeller and an operating pulley which is connected to the combustion engine for generating the rotational torque.

The electric motor does not act on the impeller independently of the combustion engine, being able only to determine variations in the speed of rotation of the impeller drive pulley. When the combustion engine is switched off, the electric motor therefore is not effective.

EP 3,096,019 and US 2004/234395 describe recirculation pumps with an electric motor in which the rotor of the electric motor is mounted directly on the impeller of the pump inside the cooling fluid chamber, while the stator is mounted inside an auxiliary sealed chamber. As well as causing a loss of efficiency due to the resistance produced by the liquid on the rotor, the dual wet/sealed chamber solution also has the effect that maintenance of the electrical part produces liquid leakages from the cooling circuit, being therefore unsuitable for application to motor vehicles.

BRIEF SUMMARY OF THE INVENTION

The technical problem which is posed therefore is that of providing a pump for recirculating fluids for engines of vehicles and the like able to produce a variation in the speed of rotation of the impeller depending on the actual cooling requirement of the engine, independently of the combustion engine, and in particular also in conditions where the combustion engine is switched off.

In connection with this problem it is also required that this control device should have small dimensions, but be able to produce high torques also at a slow speed of rotation of the engine, so as to be applicable also to high capacity pumps of heavy vehicles which have a low-speed engine or a rotation of the impeller at a slow speed in conditions where the combustion engine is operating at a high speed.

It is also required the device should be easy and inexpensive to produce and assemble and be able to be easily installed on the pump body without the need for special adaptation.

These results are obtained according to the present invention by a pump for recirculating cooling fluids for engines of vehicles and the like according to the characteristic features of Claim 1.

BRIEF DESCRIPTION OF THE SEVERAL VIEWS OF THE DRAWINGS

Further details may be obtained from the following description of a non-limiting example of embodiment of the subject of the present invention, provided with reference to the accompanying drawings, in which.

DETAILED DESCRIPTION OF THE INVENTION

Figure 1:
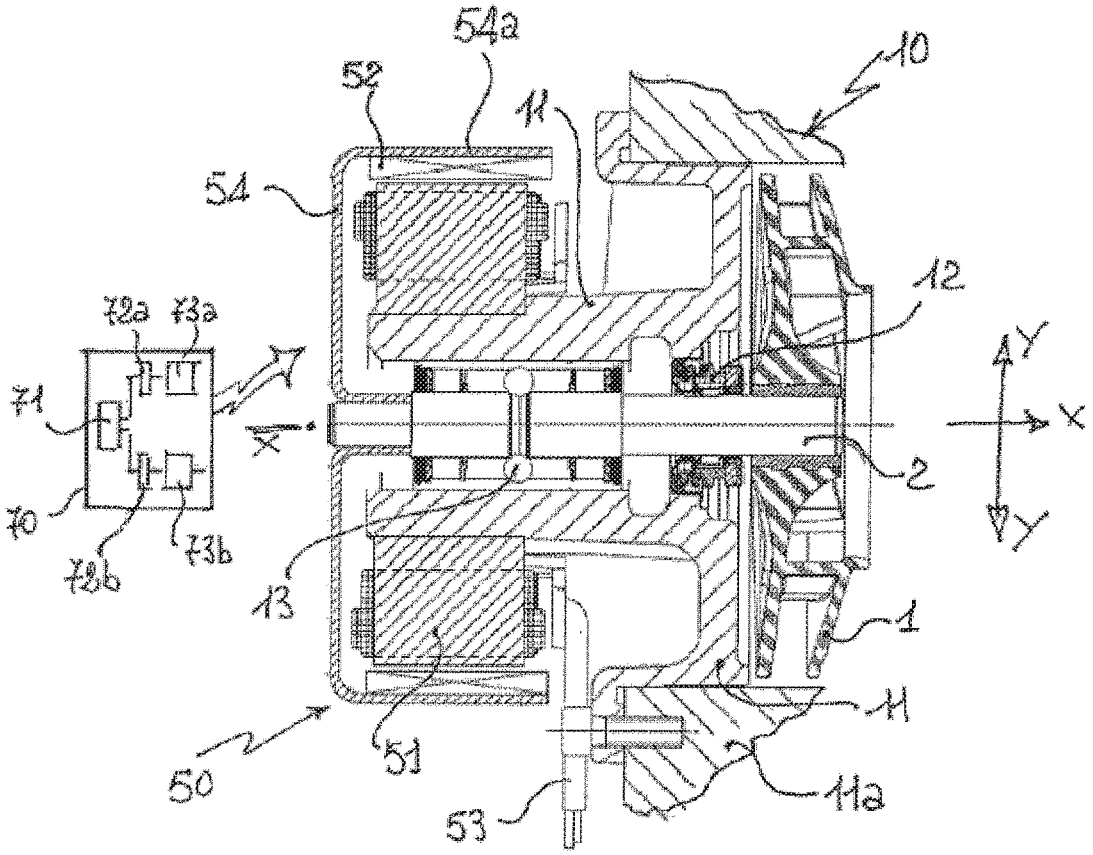
FIG. 1: shows a cross-sectional view along a vertical diametral plane of a first example of embodiment of a recirculating pump according to the present invention.

As shown in FIG. 1 and assuming without a limiting meaning a pair of reference axes, i.e. a longitudinal axis X-X, for convenience coinciding with the axis of rotation of the the pump impeller shaft, and transverse/radial axis Y-Y, orthogonal to the longitudinal axis, the impeller 1 of a pump for recirculating the cooling fluid of vehicles and the like is located inside a chamber which, during use, contains the cooling fluid and is therefore defined as being a wet chamber; the impeller 1 is mounted on a first end of a shaft 2 housed in a fixed unit 10 comprising the pump body 11 in turn fixed to the base 11*a* of the vehicle engine.

A sealing gasket 12, coaxial with the shaft 2, which ensures that the fluid inside the wet chamber is unable to seep out, and a bearing 13 on the inner race of which the impeller shaft 2 is keyed, are arranged inside the pump body 11.

An electric motor 50 is keyed on the outside of the pump body 11:

- the radially inner stator 51 thereof is supported by the said pump body 11 and
- the rotor 52 thereof, radially on the outside of the stator 51, is connected to the drive shaft 2 of the impeller, on the outside of the wet chamber of the latter. In the example shown, the rotor 52 is connected via transmission means formed by a flange 54, comprising at least one arm 54*a*, extending parallel to the longitudinal direction X-X, to which the said rotor is attached.

The electric power supply for the motor is provided via conductor wires 53 connected to an electric power source (not shown) of the motor.

According to preferred modes of implementation it is envisaged that:

- the motor is of the brushless type with permanent magnets integral with the rotor 52 rotationally driven by means of suitable electrical energization of the stator windings;
- the motor 10 comprises at least two pairs of windings on the poles of the stator which are connected in parallel to a drive 70 which drives the brushless motor.

The drive 70 may moreover comprise in turn a twin-section configuration with a CPU 71 which controls a first driver 72*a* and a second driver 72*b* for driving a respective first bridge 73*a* and second bridge 73*b*; in this way it is possible to provide a configuration known by the term "fail-safe" such that, in the event of malfunctioning or breakage of one of the windings and/or one of the sections of the drive 70, the other winding nevertheless becomes operative, guaranteeing the movement of the impeller 1 and therefore recirculation of the cooling fluid for the combustion engine.

It is envisaged moreover that the two windings may comprise a different number of polarities in order to provide different torques, for example: a high torque for normal operation and low torque for fail-safe emergency operation.

Figure 2:
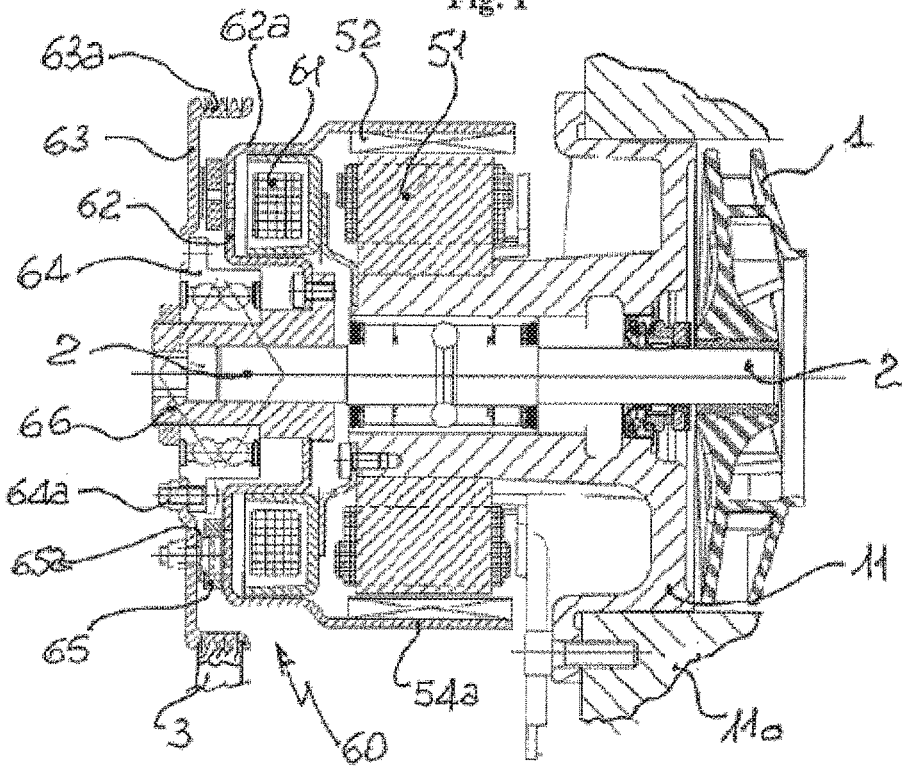
FIG. 2: shows a view similar to that of FIG. 2 of a second example of embodiment of a recirculating pump according to the present invention.

As shown in FIG. 2, a further embodiment of the cooling fluid recirculation pump is envisaged, said embodiment comprising a friction coupling 60 and control device of the electromagnetic type.

In detail the friction coupling comprises:

- an electromagnet 61 fixed to the pump body 11;
- a substantially C-shaped rotor 62 which is arranged on the outside of the electromagnet 61 and is connected to a sleeve 66 keyed onto the shaft 2 of the impeller 1;
- a circular ring 63 which is situated axially on the outside of the rotor 62 on the opposite side to the impeller 1 and is suitably shaped and which has, formed on its outer circumferential edge, a pulley 63*a* suitable for engagement with a belt 3 for transmission of the movement from the shaft of the combustion engine; the ring 63 is fixed by means of screws 64*a* to a bearing 64 in turn keyed onto the said sleeve 66 integral with the shaft 2 of the impeller 1;
- an armature 65 arranged in front of the electromagnet 61 on the opposite side to the latter relative to the rotor 62 and connected to the ring 63 by means of a resilient membrane 65*a* designed to allow movements of the armature in the axial direction, but preventing relative rotation thereof with respect to the said ring.

As shown, the radially outer axial arm 62*a* of the C-shaped rotor 62 is joined together—or preferably formed as one piece—with the arm 54*a* supporting the rotor 52 of the electric motor 50.

Figure 3:
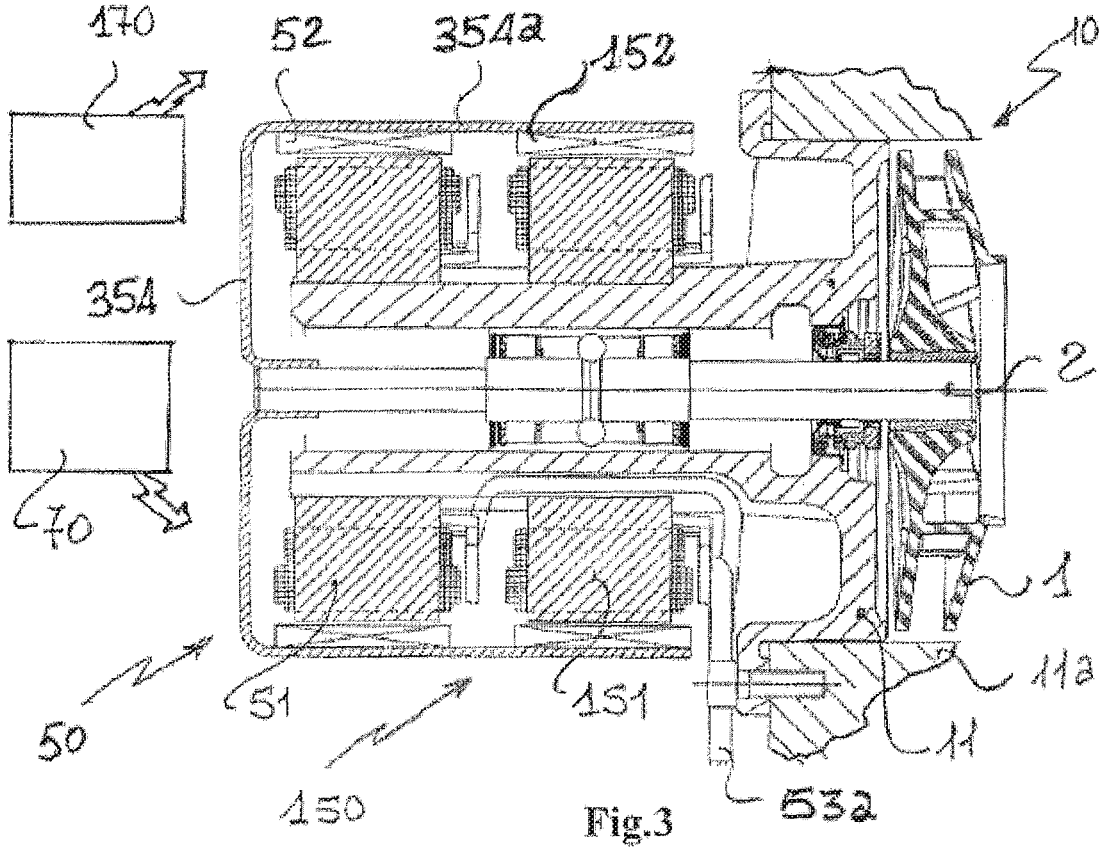
FIG. 3: shows a view similar to that of FIG. 1 of a third example of embodiment of a recirculating pump according to the present invention.

FIG. 3 shows a third embodiment of the pump according to the invention which envisages in this case:

- a first motor 50 with stator 51 keyed onto the pump body 11 and a second motor 150 with stator 151 keyed onto the pump body coaxially with the first motor 50;
- the rotor 52 of the first motor 50, situated radially on the outside of the stator 51, and the rotor 152 of the second motor 350, situated radially on the outside of the stator 151, are connected to the shaft 2 of the impeller 1 via transmission means formed by a flange 354 comprising at least one arm 354*a* extending, parallel to the longitudinal direction X-X, over a length such as to allow the two said rotors 52,152 to be linked together.

The electric power supply for the motor is obtained conventionally via conductor wires 53 connected to an electric power source (not shown) of the motor.

In the case of the motor 150 also, it is possible to provide fail-safe operation with twin stator windings which are controlled by a respective second drive 170 similar to the drive 70 for controlling the first motor 50 of the pump and therefore not described again in detail.

The presence of the second motor 150 in addition to the first motor 50 allows, among other things, the overall dimensions and in particular the radial dimensions of said motors to be reduced, simplifying the assembly operations, and also allows the power consumption of each motor to be divided up compared to the power consumption of a single large-size motor.

For all the configurations shown in FIG. 1, FIG. 2 and FIG. 3 the operation of the pump is as follows:

- under normal operating conditions, the supplying of a variable current to the stator 51 results in a magnetic field which, in concatenation with the permanent magnets of the rotor 52, causes rotation of the latter and therefore the flange 54 (FIG. 1) or rotor 62 (FIG. 2) or flange 354 (FIG. 3) which in turn operate the shaft 2 of the pump and therefore the impeller 1;
- in the event of malfunctioning and/or breakage of certain parts of the assembly the fail-safe device intervenes, this comprising:
  - in the case of FIG. 1, intervention of either one of the two stator windings which is still active;
  - in the case of FIG. 2, intervention of the friction coupling 60 which, by means of excitation of the electromagnet 61, recalls the armature 65, connecting the rotor 62 to the ring 63 and therefore to the combustion engine by means of the pulley 63*a* and the belt 3;
  - in the case of FIG. 3, intervention of either one of the two motors 50,150.

It is therefore clear how, with the pump according to the invention, it is possible to achieve effective recirculation of the vehicle cooling fluid, which may be varied depending on the actual requirement by means of suitable sizing/energization of the electric motor and with improved efficiency of the torque transmitted from the electric motor to the pump impeller 1, owing to the greater lever arm resulting from the radially outer arrangement of the rotor connected to the pump shaft.

Moreover, owing to the provision of the motor rotor on the outside of the stator, in the preferred embodiment it is possible to obtain a single-piece connection to the pump shaft or to the rotor of the electromagnetic friction coupling, thus resulting in simplified machining and assembly as well as smaller masses and therefore a lower energy consumption both during production and when the pump is mounted on the combustion engine.

In addition, the pump according to the invention ensures rotation of the impeller 1 also in the event of an electrical fault, thus avoiding stoppage of the vehicle before it reaches its destination.

Although described in connection with a number of embodiments and a number of preferred examples of implementation of the invention, it is understood that the scope of protection of the present patent is determined solely by the following claims.

The invention claimed is:

1. A pump for recirculating a cooling fluid for a vehicle with a combustion engine, comprising:

a pump body (11) designed to be fixed to a base (11*a*) of the combustion engine;

an impeller (1) inserted inside a chamber containing the cooling fluid and mounted on a driven shaft (2); and at least one first electric motor (50) for driving the shaft (2) of the impeller (1), wherein said electric motor (50) comprises a fixed stator (51) mounted on the body (11) of the pump on an outside thereof and a rotor (52) radially outer lying with respect to the stator and connected to the shaft (2) of the impeller (1) of the pump on an outside of the cooling fluid chamber and via a transmission means (54,54*a*; 354,354*a*;54*a*,66), and wherein the electric motor is designed to operate the impeller independently of the combustion engine.

2. The pump according to claim 1, wherein said transmission means comprises a flange (54) which has an annular edge (54*a*), extending parallel to the longitudinal direction X-X, and to which the rotor (52) is attached.

3. The pump according to claim 1, further comprising a fail-safe device.

4. The pump according to claim 3, wherein said fail-safe device comprises at least two pairs of windings on the poles of the stator (51) which are connected in parallel to a drive (70) which drives the motor.

5. The pump according to claim 3, wherein said fail-safe device comprises at least one friction coupling (60) arranged between means (3) for transmission of the movement from the shaft of the combustion engine and the shaft (2) of the pump impeller (1).

6. The pump according to claim 5, wherein said friction coupling (60) is of an electromagnetic type.

7. The pump according to claim 6, wherein said friction coupling (60) comprises an electromagnet (61) fixed to the pump body (11), a rotor (62) substantially in the form of a "C" arranged around the electromagnet (61) and connected to a sleeve (66) keyed onto the shaft (2) of the impeller (1);

a circular ring (63) which is situated axially on an outside of the rotor (62) on an opposite side to the impeller (1) and which has, formed on its outer circumferential edge, a pulley (63*a*) suitable for engagement with a belt (3) for transmission of the movement from the shaft of the combustion engine, the ring (63) being fixed to a bearing (64) in turn keyed onto the said sleeve (66) integral with the shaft (2) of the impeller (1);

an armature (65) arranged in front of the electromagnet (61) on the opposite side to the latter relative to the rotor (62) and connected to the ring (63) by means of a resilient membrane (65*a*) designed to allow movements of the armature in the axial direction, while preventing relative rotation thereof with respect to said ring.

8. The pump according to claim 7, wherein the rotor (62) of the coupling (60) is integral with a support (54*a*) of the rotor (52) of the electric motor (50).

9. The pump according to claim 8, wherein the rotor (62) of the coupling (60) is formed as one piece with said support (54*a*) of the rotor (52) of the electric motor (50).

10. The pump according to claim 3, wherein said fail-safe device comprises a second electric motor (150) mounted on the pump body (11) coaxially with the first motor (50) and driven by a second drive (170).

11. The pump according to claim 10, wherein said transmission means comprises a flange (354) which has an annular edge (354*a*), extending parallel to the longitudinal direction X-X, over a length such as to allow linking together of the two rotors (52,152).

12. The pump according to claim 1, wherein the one or more electric motors (50;150) are of a brushless type.

13. The pump according to claim 1, wherein a drive (70;170) of the one or more electric motors (50;150) comprises a twin-section configuration with a CPU (71) for controlling a first driver (72*a*) and a second driver (72*b*) for driving a respective first bridge (73*a*) and second bridge (73*b*).

* * * * *